US005390448A

United States Patent [19]

Schimweg

[11] Patent Number: 5,390,448

[45] Date of Patent: Feb. 21, 1995

[54] MODULAR EXPANDABLE HONING TOOL

[75] Inventor: John J. Schimweg, St. Charles, Mo.

[73] Assignee: Sunnen Products Company, St. Louis, Mo.

[21] Appl. No.: 51,499

[22] Filed: Apr. 22, 1993

[51] Int. Cl.[6] ..... B24B 33/02; B24B 33/08

[52] U.S. Cl. ..... 451/478; 451/470

[58] Field of Search ..... 51/338, 346, 340, 343

[56] References Cited

U.S. PATENT DOCUMENTS

| | | | |
|---|---|---|---|
| 2,694,277 | 11/1954 | Speck | 51/346 |
| 3,710,518 | 1/1973 | Grosseau | 51/338 |
| 4,099,350 | 7/1978 | Hasty | 51/338 |
| 4,462,189 | 7/1984 | Puybaraud | 51/338 |
| 5,022,196 | 6/1991 | Schimweg et al. | 51/338 |
| 5,178,643 | 1/1993 | Schimweg | 51/293 |

FOREIGN PATENT DOCUMENTS

| | | | |
|---|---|---|---|
| 0060197 | 9/1982 | European Pat. Off. | 51/338 |
| 3341507 | 5/1985 | Germany | 51/338 |
| 0146657 | 11/1981 | Japan | 51/338 |

*Primary Examiner*—Robert A. Rose
*Attorney, Agent, or Firm*—Haverstock, Garrett & Roberts

[57] ABSTRACT

A honing tool or mandrel mountable for rotation on a honing machine comprising a tubular abrasive sleeve member retained coaxially within a modular tubular honing assembly having an opening or passageway extending the entire length therethrough adaptable for insertably receiving an elongated expander member positioned for axial movement therewithin. The modular tubular honing assembly includes a drive member for attaching to a typical honing machine, a cage member adaptable for slidably receiving the abrasive sleeve member, and a retainer member for holding the abrasive sleeve member in operative position within the cage member. The abrasive sleeve member has inner and outer surfaces, the inner surface being conically tapered over its entire length while its outer surface includes a plurality of circumferentially spaced longitudinal projections positioned adjacent longitudinal channels, each projection including a honing surface having abrasive particles located thereon. The abrasive sleeve member also includes an elongated slot extending along its entire length on one side thereof which enables such member to uniformly radially expand and contract when the expander member is axially moved therethrough, the expander member having at least a portion of its outer surface which extends through the abrasive sleeve member likewise tapered at the same conical taper rate as the taper associated with the inner surface of the abrasive sleeve member for making surface-to-surface contact with the tapered inner surface of the abrasive sleeve member. Axial movement of the expander member within the abrasive sleeve member changes the diameter of the sleeve member uniformly along its entire length during a honing operation.

22 Claims, 4 Drawing Sheets

MODULAR EXPANDABLE HONING TOOL

The present invention relates to an expandable honing tool or mandrel which is adjustable within limits during a honing operation and, more particularly, to a modular honing mandrel which includes a tubular abrasive sleeve member having an elongated slot extending along its entire length on one side thereof, a cage assembly for holding the abrasive sleeve member in operative position during a honing operation, a tubular drive member, and a retainer or pilot member, all of which members are mounted coaxially to form the modular assembly portion of the overall tool. When assembled, the present modular honing tool includes an opening extending therethrough from end to end adaptable for cooperatively receiving an elongated expander member or wedge assembly, the expander member or wedge assembly being axially movable within the modular assembly to expand the abrasive sleeve member uniformly over its entire length to increase or decrease the diameter thereof. The present honing tool construction is particularly adaptable for use in multi-stroke honing applications wherein increases and decreases in the honing tool diameter can be accomplished during a honing operation. Use of the present honing tool produces uniform and accurately honed work surfaces with a much greater range of honing diameter adjustability in a honing operation, while providing for quicker and easier removal and replacement of the various honing tool components.

BACKGROUND OF THE INVENTION

Many different types of honing mandrels and other honing devices have been designed and manufactured in the past for a wide variety of uses and applications. Most notable of these prior art devices are the multi-stroke adjustable honing mandrel constructions shown and disclosed in Sunnen U.S. Pat. No. 5,022,196. These honing mandrel constructions enable a user to achieve a more uniform and more accurately honed work surface with a much greater range of honing diameter adjustability as compared to the earlier known adjustable tool constructions and, especially, single pass through honing devices, many of which are identified and discussed in U.S. Pat. No. 5,022,196.

While these features in a honing tool represent an important advancement in the honing art, improvements to the design of an expandable honing tool making it easier and more economical to construct, simpler to operate, and quicker and easier to adjust during the honing operation, while still maintaining the quality of the work performed, are desirable. The present modular honing tool incorporates all of the above desired features and represents an improvement over the honing tool constructions disclosed in U.S. Pat. No. 5,022,196 for certain honing applications.

SUMMARY OF THE INVENTION

The present invention teaches the construction and operation of a modular honing tool or mandrel mountable for rotation on a honing machine, the present mandrel including a tubular abrasive sleeve member retained coaxially within a modular substantially tubular honing assembly having an opening or passageway extending the entire length therethrough adaptable for insertably receiving an elongated expander member or wedge assembly positioned for axial movement therewithin. The tubular honing assembly includes a drive member having one end portion configured to be received and rigidly retained by means on the spindle mechanism associated with a typical honing machine, a cage member having one end portion adaptable for threadedly receiving the opposite end portion of the drive member and having its opposite end portion adaptable for receiving the abrasive sleeve member, and a retainer or pilot member affixed to the opposite end portion of the cage member for holding and retaining the abrasive sleeve member in operative position therewithin.

The abrasive sleeve member includes inner and outer surfaces, the inner surface being conically tapered over substantially its entire length, while the outer surface includes a plurality of circumferentially spaced radially outwardly extending longitudinal portions or projections positioned adjacent circumferentially spaced longitudinally recessed portions or channels, each channel having a face surface longitudinally tapered over substantially its entire length at the same taper rate as the conical taper associated with the inner surface of the abrasive sleeve member. This taper relationship is important to the present tool construction because it is this specific structural relation between the inner surface and the channel faces of the abrasive sleeve member which provides a sleeve wall of more uniform thickness throughout its length, which uniform wall thickness ensures a more uniform expansion and contraction of the abrasive sleeve member as the wedge or expander member is axially moved therethrough. In this regard, one channel face of the abrasive sleeve member includes a narrow slot or groove through the wall of the sleeve member along its entire length to enable such member to radially expand and contract as the expander member is advanced or retracted axially therein. If the wall thickness of the sleeve member is not held substantially uniform over its length but is allowed to otherwise vary, uniform expansion and contraction of the sleeve member would be severely impeded.

It is important to note that the outermost surfaces of the circumferentially spaced longitudinal abrasive sleeve projections are not longitudinally tapered as is true of the adjacent recessed channel portions, but instead, such projections occupy areas which extend parallel to the axis of the abrasive sleeve member. These outermost surfaces of the raised projections include honing surfaces having abrasive particles attached thereto, all of which are located on a substantially cylindrical honing envelope along the entire length of the abrasive sleeve member. This enables the raised abrasive surface projections of the sleeve member to be maintained in operative engagement with the work surface during honing and, importantly, also allows the abrasive surface projections to radially expand uniformly along their lengths during a honing operation, as will be hereinafter explained, thereby producing more uniform and more accurately honed work surfaces.

The present cage member includes a plurality of circumferentially spaced fingers extending longitudinally from one end portion thereof, each finger corresponding to, and lying in registration with, a respective channel associated with the abrasive sleeve member when the sleeve member is positioned in operative engagement with the cage member. Each cage finger has an inner surface and an outer surface, the inner surface being likewise conically tapered over substantially its entire length at the same taper rate as the longitudinal taper associated with the channel faces of the abrasive sleeve member. The construction of the present cage member is such that when the abrasive sleeve member is fully mounted in operative engagement therewith, with each finger positioned within a respective sleeve channel, each channel face is in spaced relation to, and opposes, the inner surface of each corresponding finger. This is also important for reasons hereinafter explained.

The present retainer or pilot member includes a flange formed about one end portion thereof, and a beveled opposite end. The dimensions of the pilot flange are such so as to permit it to be affixed to the opposite end of the cage member when the pilot is coaxially aligned therewith. The beveled end of the pilot serves as guide means for guiding the mandrel into the aperture of the workpiece to be honed.

The present expander member or wedge includes a portion thereof having an outer surface which is similarly conically tapered over the length thereof at the same taper rate as the conical taper associated with the inner surface of the abrasive sleeve member into which it is positioned, this tapered portion of the expander member extending through, and being concentrically aligned with, the abrasive sleeve member when positioned therethrough. The remaining portion of the expander member is cylindrical along its entire length and is of a diameter which is smaller than the smallest diameter associated with the tapered portion of the wedge. This means that when the expander member is positioned within the modular assembly, the outer surface of the tapered portion thereof is in surface-to-surface contact with the inner surface of the abrasive sleeve member. This specific constructional arrangement between the expander member and the abrasive sleeve member enables the diameter of the sleeve member to be expanded and contracted uniformly over its entire length as the expander member is axially moved therethrough. In this regard, one end of the expander member is attached to means associated with the honing machine which is operable to produce relative axial movement between the expander member and the abrasive sleeve to change the diameter of the outer surface of such member.

During a honing operation, the present tool is rotatable about an axis of rotation. Because the entire mandrel assembly including the abrasive sleeve member and the expander member rotates during a honing operation while the expander member is axially moved therein, it is important that relative rotational movement between the abrasive sleeve member and the expander member be prevented. In U.S. Pat. No. 5,022,196, several keying means for preventing such relative rotational movement are disclosed. Each of the means disclosed in such prior art patent would involve structurally designing the abrasive sleeve and the expander member of the present invention so that each such member cooperatively engages the other when the expander member is inserted through the sleeve member. Such keying means contribute cost to the manufacture of a honing mandrel and mandate that only a specific expander member be used with a given abrasive sleeve member.

The present mandrel construction does not utilize the keying arrangement disclosed in U.S. Pat. No. 5,022,196. In contrast, the keying means for the present tool are contained on the rotatable member to which the mandrel is attached, thereby eliminating the need for including specific keying means on the mandrel itself. This reduces the overall cost of manufacturing the present mandrel over prior art designs, while providing greater versatility in use since it is no longer necessary to use a specific tubular honing assembly and abrasive sleeve member with a given expander member. The present construction further allows a plurality of different abrasive sleeve members each having abrasive honing surfaces located at different honing diameters to be utilized with the same cage member. It is also anticipated that differently sized cage members as well as differently sized expander members and pilot members can likewise be interchangeably utilized with a given drive member of the present invention. This greatly increases the capability of the present tool.

It is therefore a principal object of the present invention to teach the construction and operation of a modular expandable and retractable honing tool for finishing and sizing work surfaces accurately and uniformly.

Another object is to provide a modular honing tool wherein the abrasive sleeve member is constructed in such a way as to promote uniform expansion and contraction during honing.

Another object is to provide a modular honing tool that will allow the abrasive honing member to be removed and replaced without removing the entire mandrel from the honing machine.

Another object is to provide a modular honing tool that will allow various components of the tool to be removed and replaced without removing the entire mandrel from the honing machine.

Another object is to provide a modular honing tool which obviates the need for using a specific keying means arrangement between its abrasive honing member and the expander member.

Another object is to provide a modular honing tool constructed to permit a plurality of abrasive sleeve members as well as a plurality of expander members to be interchangeably used with a given tool assembly.

Another object is to teach the construction of a modular expandable honing tool having improved means for allowing coolant to flow around the abrasive sleeve member during a honing operation so as to flush or wash away stock material removed from the work surface being honed, which stock material would cause galling and/or scoring of the honed work surface if allowed to accumulate within the recessed channels of the abrasive sleeve member.

Another object is to provide an expandable honing tool particularly adapted for use in larger diameter bores such as connecting rod journal bores for reciprocating engines.

Another object is to provide a modular expandable honing tool that can operably receive abrasive sleeve members of various honing surface diamaters on the same cage member.

Another object is to provide a honing mandrel which is easier and more economical to manufacture.

These and other objects and advantages of the present invention will become apparent to those skilled in the art after considering the following detailed specification in conjunction with the accompanying drawings.

DETAILED DESCRIPTION OF THE INVENTION

Figure 1:
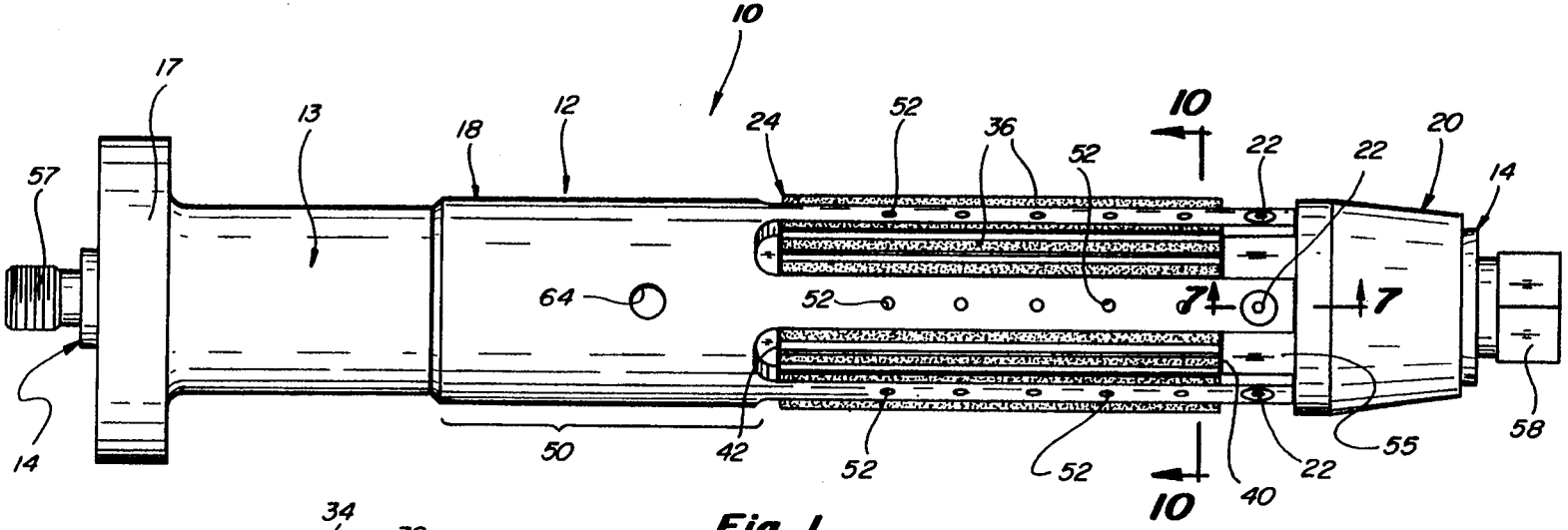
FIG. 1 is a side elevational view of a modular honing mandrel constructed according to the teachings of the present invention.
Figure 6:
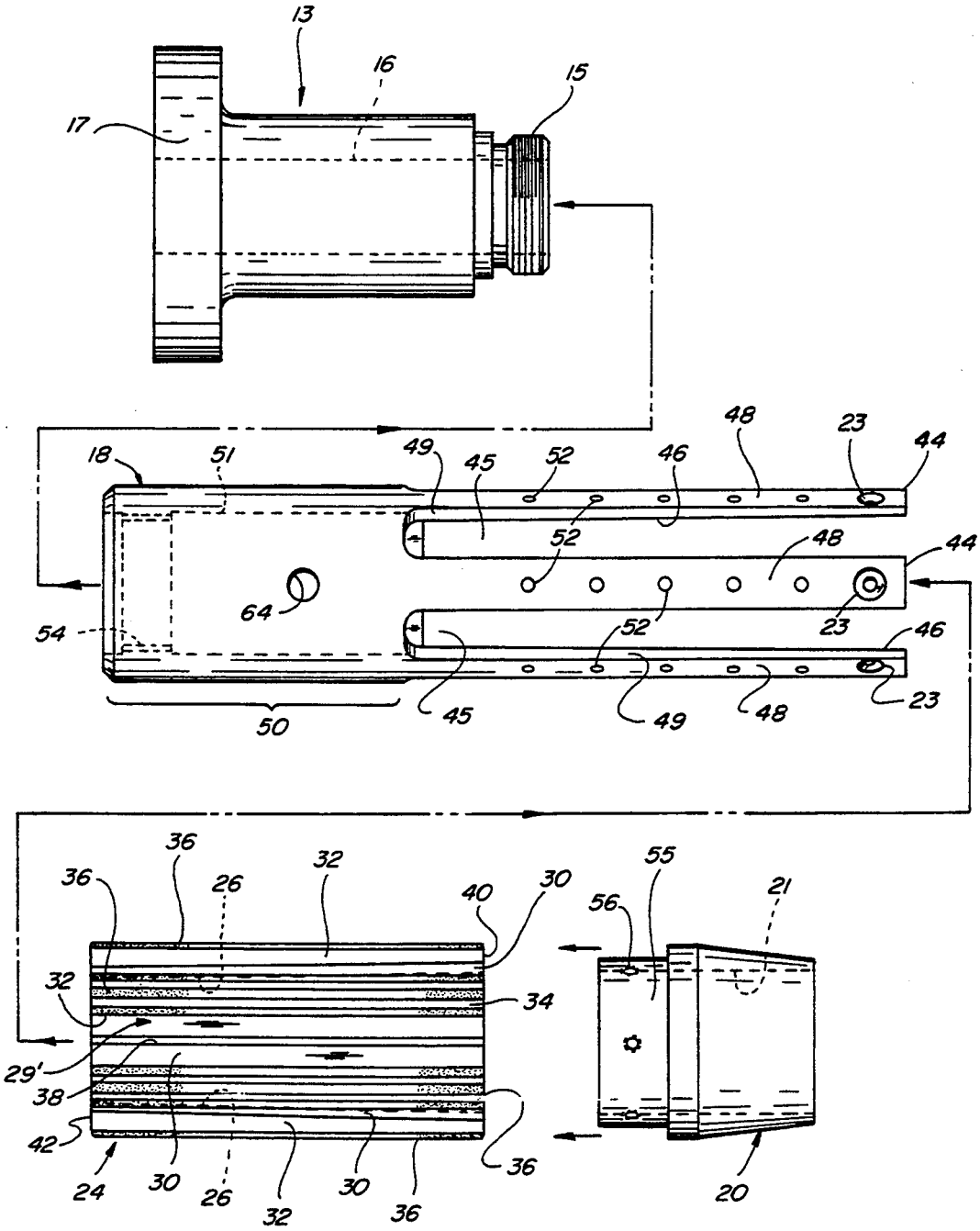
FIG. 6 is an exploded side elevational view illustrating how the drive member, cage member, abrasive sleeve member, and pilot member are positioned for cooperative engagement with each other.
Figure 7:
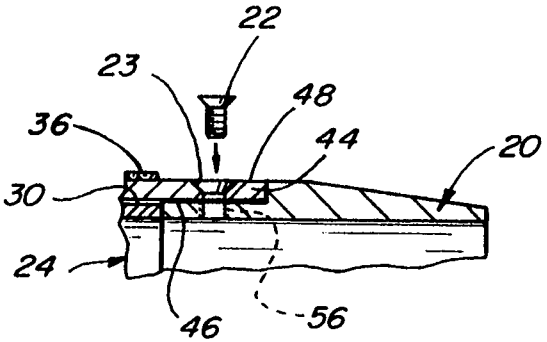
FIG. 7 is a cross-sectional view taken along line 7—7 of FIG. 1.

Referring to the drawings more particularly by reference numbers wherein like numerals refer to like parts, number 10 in FIG. 1 identifies a honing tool or mandrel constructed according to the teachings of the present invention. The mandrel 10 includes a modular tubular honing assemby 12 having a common passageway extending therethrough from end to end, the common passageway being adaptable for cooperatively receiving an elongated expander member or wedge assembly 14. The modular honing assembly 12 includes a drive member 13 as shown in FIGS. 1 and 6, a cage member 18 as shown in FIGS. 1, 4, 5, 6 and 10, and a retainer or pilot member 20 as shown in FIGS. 1, 6 and 7. The drive member 13 (FIG. 6) has one end portion 17 configured so as to be received and rigidly retained by means on the spindle mechanism of a typical honing machine (not shown) and includes threaded means 15 on its opposite end portion for threadedly engaging one end portion of the cage member 18. The retainer or pilot member 20 is affixed to the opposite end portion of the cage member 18 by means of a plurality of screws or other fastening means 22 which extend through countersunk apertures 23 circumferentially located on the cage fingers 44 as will be hereinafter further explained. An abrasive sleeve member 24 is operatively mounted within the cage member 18 as will be likewise hereinafter explained.

Figure 3:
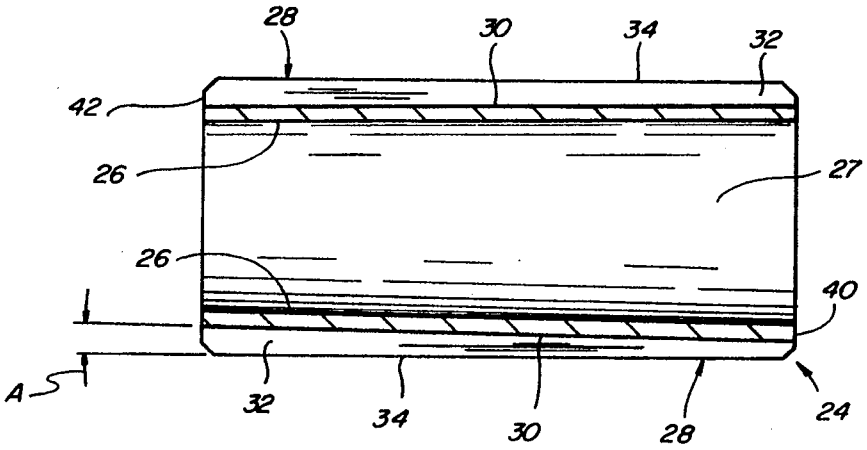
FIG. 3 is an axial cross-sectional view of the abrasive sleeve member taken along line 3—3 of FIG. 2.
Figure 2:
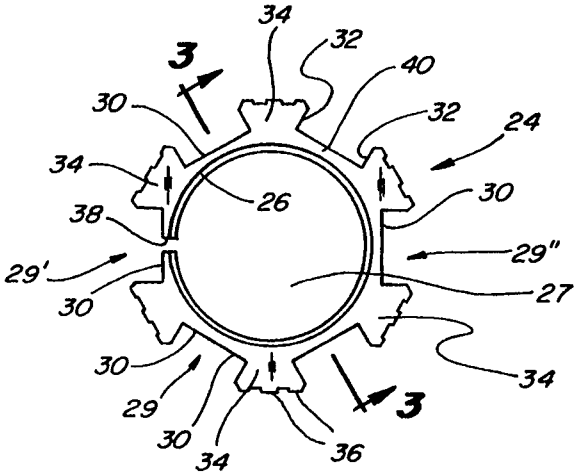
FIG. 2 is an end view of the expandable abrasive sleeve member of the present invention, this view being taken from the end of the sleeve member into which the expander member is inserted.

As illustrated in FIGS. 2 and 3, the abrasive sleeve member 24 has an inner surface 26 defining a passageway 27 extending therethrough from end to end along its entire length and an outer surface 28. The outer surface 28 includes a plurality of circumferentially spaced longitudinal channels 29, each channel 29 being defined by a planar channel face 30 which is recessed between opposing parallel sidewalls 32, all of the channel faces 30 being equal in width to each other. The outer surface 28 also includes a plurality of circumferentially spaced longitudinal projections 34, each projection 34 separating a respective pair of channels 29 and each having a longitudinal honing surface 36 extending along the full length thereof, the honing surface 36 being defined by those portions of each projection 34 which are radially spaced farthest from the longitudinal axis of the abrasive sleeve member 24. In the preferred embodiment, the honing surfaces 36 are substantially planar and are coated or plated over at least a portion thereof with an abrasive material such as a material which includes diamond particles or particles of cubic boron nitride in a suitable binder or other like hard substances. Use of such abrasive materials is well known in the honing art. Although the abrasive honing surfaces 36 illustrated in FIGS. 2 and 3 are shown as being arranged in a spaced apart fluted configuration, it is recognized that a wide variety of different abrasive patterns may be utilized depending upon the particular application desired and the type of abrasive material being used.

The abrasive sleeve member 24 also includes an elongated slot 38 located through the channel face 30 of one of the channels 29 as best shown in FIGS. 2 and 6, the channel 29 containing the slot 38 being hereinafter designated the expansion channel 29' illustrated in FIG. 2. The slot 38 extends the full length of one side of the sleeve member 24 to permit uniform expansion and contraction thereof when the expander member 14 is axially moved within the passageway 27. For reasons hereinafter discussed, the channel 29 positioned directly opposite the expansion channel 29' will be hereinafter designated as the drive channel 29''.

Importantly, the inner surface 26 of the abrasive sleeve member 24 is axially conically tapered throughout its entire length as is more clearly indicated by reference to the angle A illustrated in FIG. 3, the cross-sectional diameter of the sleeve passageway 27 being its greatest at the sleeve end 40 into which the expander member 14 is inserted, and being at its minimum at the opposite sleeve end 42. The taper associated with the inner sleeve surface 26 is shown somewhat exaggerated in FIG. 3 for clarity, while in the actual device, this taper is relatively slight. Because uniform expansion and contraction of the abrasive sleeve member 24 is achieved when the wall thickness of such member is uniform throughout its length, the planar channel faces 30 are likewise longitudinally tapered at the same taper rate as the inner sleeve surface 26. This ensures wall thickness uniformity in the sleeve member 24 to the maximum extent possible.

Figure 4:
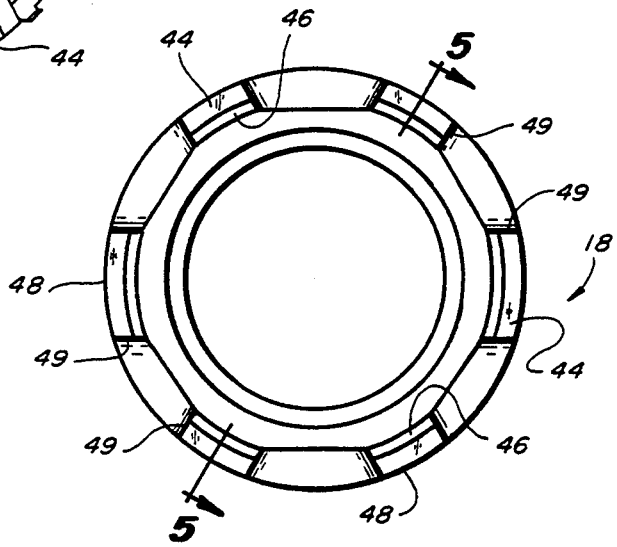
FIG. 4 is an enlarged end view of the cage member of the present invention which cooperatively receives the abrasive sleeve member of FIGS. 2 and 3, this view being taken from the end of the cage member into which the abrasive sleeve member is inserted.
Figure 5:
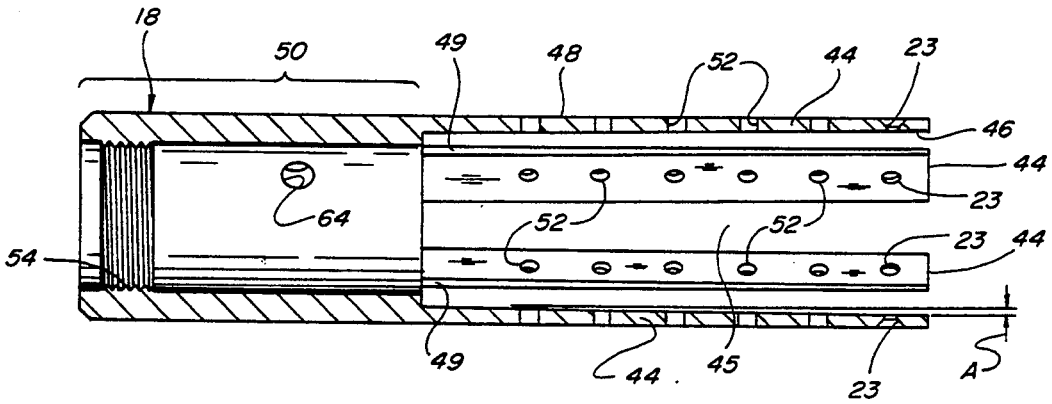
FIG. 5 is an axial cross-sectional view of the cage member taken along line 5—5 of FIG. 4.

Referring to FIGS. 4 and 5, a plurality of circumferentially spaced fingers 44 extends longitudinally from one end of a tubular portion 50 of the cage member 18, there being one finger 44 corresponding to each channel 29 in the abrasive sleeve member 24. Each finger 44 has a transversely concave inner surface 46, a transversely convex outer surface 48, and opposed parallel side edge surfaces 49, the width of each finger 44 being less than the distance between the opposed sidewalls 32 defining each respective channel 29. Each pair of adjacent fingers 44 define a longitudinal slot or aperture 45 therebetween, the plurality of longitudinal slots 45 being circumferentially spaced between the fingers 44 as best shown in FIGS. 5 and 6.

Figure 10:
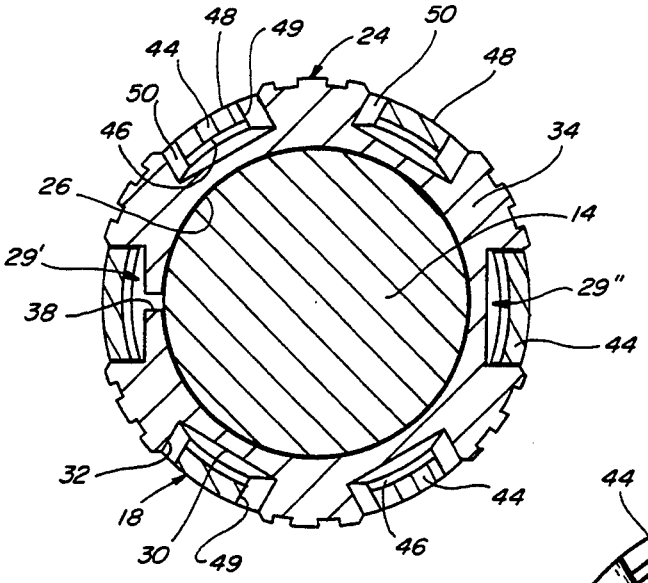
FIG. 10 is an enlarged cross-sectional view of the present mandrel taken along line 10—10 of FIG. 1.

The inner surfaces 46 of the fingers 44 are likewise conically tapered longitudinally at the same taper rate as the abrasive sleeve channel faces 30 as is also more clearly indicated by reference to the angle A illustrated in FIG. 5. As more clearly illustrated in FIGS. 4 and 10, the cage fingers 44 are circumferentially arranged in spaced opposed relationship to each other. The distance between the inner surfaces 46 of opposing fingers 44 is such that when the abrasive sleeve member 24 is positioned and oriented relative to the cage member 18 such that each finger 44 is aligned with a respective channel 29, and the taper of the respective channel faces 30 runs parallel to the taper of the respective inner finger surfaces 46, the abrasive sleeve member 24 can be fully inserted and received between the cage fingers 44 so as to position the channel faces 30 in registration with the inner finger surfaces 46 as is best shown in FIGS. 6 and 10. When so positioned and engaged, the inner finger surfaces 46 do not lie in flush abutting relationship with the channel faces 30, but instead, a space exists between these two mating surfaces. This space occurs due to the limited extent to which the sleeve member 24 can be slidably advanced within the cage member 18, this limited movement occurring due to the fact that the opposite end 42 of the abrasive sleeve 24 abuts the tubular cage portion 50 and, importantly, allows expansion of the sleeve member 24 to take place without having the channel faces 30 come into direct contact with the fingers 44. This prevents bowing or other deformation to the cage fingers 44 during expansion of the sleeve member 24.

It should be noted that the outer surfaces 48 of the fingers 44 are parallel to the longitudinal axis of the cage member 18. This means that the fingers 44 are thicker at one end than at the other end. The thicker end portion of each finger 44 forms a base of uniform construction with, and extends longitudinally from, one end portion of the tubular cage portion 50 as best shown in FIGS. 5 and 6. It can, therefore, be understood that the inner surface 46 of each finger 44 is conically tapered such that the maximum thickness of each such finger 44 is at its base where the finger 44 merges with the tubular cage portion 50. This also provides strength and rigidity to each finger 44 at its point of connection to the tubular cage portion 50, while at the same time preventing structural interference between the inner finger surfaces 46 and the abrasive sleeve channel faces 30 when the sleeve member 24 is slidably mounted to the cage member 18.

A plurality of apertures 52 are located along the length of each finger 44 as best shown in FIGS. 1, 5, and 6. These openings 52 are provided so that a liquid coolant can be circulated therethrough and around the abrasive sleeve 24 during a honing operation so as to flush away stock material, which accumulates during the honing process, before such material builds up on, and adheres or otherwise bonds to, the sleeve member 24. The openings 52 substantially reduce and minimize the occurrence of having stock material build up and collect within the sleeve channels 29 as well as between the sidewalls 32 and the cage fingers 44, thereby facilitating and hopefully preventing galling or scoring of the honed work surface which would otherwise occur if such stock build-up was allowed to accumulate. It should also be noted that the concavity of the inner surface 46 of each finger 44 is so created so as to ensure that, even if the sleeve member 24 is expanded to the point that the channel faces 30 are pressed against their respective fingers 44, a sort of tunnel passageway will be formed between the concave inner surface 46 of each finger 44 and the corresponding planar channel face 30 through which the honing coolant can continue to flow.

Threaded means 54 are also provided on the end of the tubular cage portion 50 opposite the fingers 44 as best shown in FIG. 5, which threaded means 54 cooperatively engage corresponding means 15 (FIG. 6) located on the drive member 13 for removably attaching the cage member 18 thereto. This construction allows an operator to quickly and easily change and remove the cage member 18 from the tool assembly 10, if necessary, without disconnecting the drive member 13 from the honing machine. In this regard, the tubular cage portion 50 also includes a passageway 51 extending therethrough from end to end as best shown in FIG. 6, the passageway 51 being adaptable for receiving at least a portion of the expander member 14 as will be hereinafter further explained.

FIG. 6 illustrates how the drive member 13, the cage member 18, the abrasive sleeve member 24, and the retainer or pilot member 20 are positioned and aligned for cooperative engagement with each other. When the sleeve member 24 is coaxially aligned with the cage member 18, the abrasive honing surfaces 36 are spaced radially outwardly farther from the longitudinal axis of the sleeve member 24 than the inner surfaces 46 of the fingers 44. This means that the fingers 44 must be aligned with the respective sleeve channels 29 and the raised honing projections 34 must be aligned with the respective longitudinal slots 45 before the sleeve member 24 can be slidably inserted therebetween into the cage assembly 18. In this regard, the cage slots 45 must likewise be dimensioned to receive the honing projections 34. Since fingers 44 are longer than the length of the sleeve 24, when the fingers 44 are positioned within their respective sleeve channels 29 and the opposite sleeve end 42 is placed in abutment with the tubular cage portion 50, a portion of each respective finger 44 including the countersunk apertures 23 associated respectively therewith extends beyond the sleeve end 40. The pilot 20 is then brought into coaxial alignment with the cage member 18, and a flange 55 on the pilot 20 is slidably mounted into the cage member 18 so that the countersunk apertures 23 of the fingers 44 overlap the flange 55, as is best shown in FIG. 1. Threaded apertures 56 located in the flange 55 are circumferentially spaced to coincide and register with the countersunk apertures 23 when the pilot 20 is coaxially aligned and engaged with the cage member 18. This means that the apertures 56 are placed in registration with the countersunk apertures 23 so that the screws or other fastening means 22 can be inserted respectively therethrough to fixedly retain the pilot 20 in engagement with the cage member 18, as is best shown in FIG. 7. The pilot 20 likewise includes a passageway 21 extending completely therethrough, as is best shown in FIG. 6, for insertably receiving the expander member 14.

Figure 8:
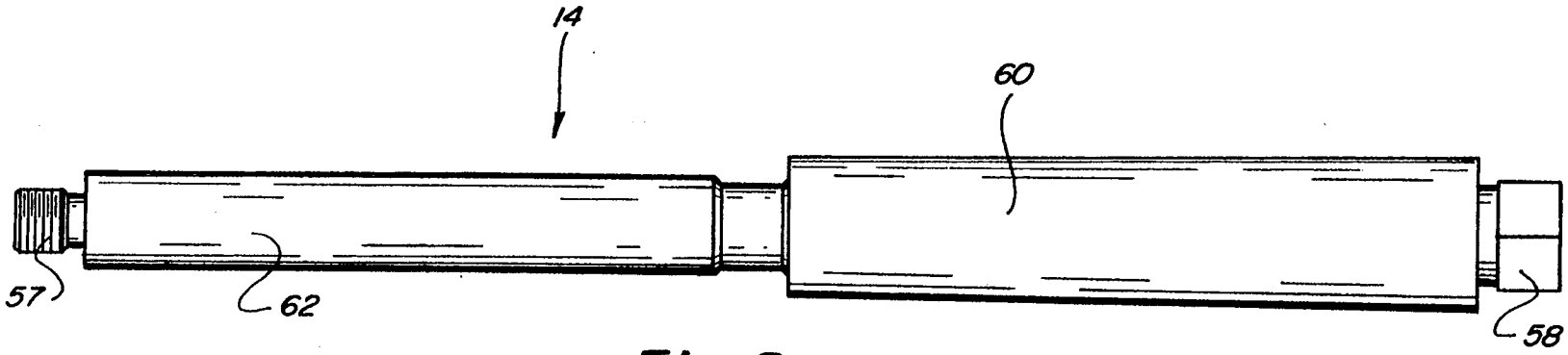
FIG. 8 is a side elevational view of the expander member or wedge assembly which is cooperatively receivable within the various components of the modular assembly of FIG. 6.
Figure 9:
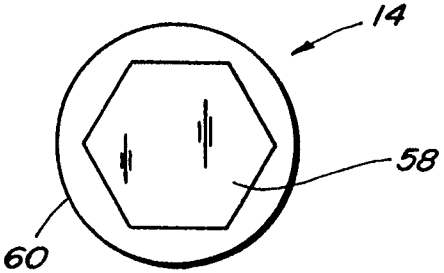
FIG. 9 is an end view of the expander member of FIG. 8 showing its hexagonal head configuration.

The expander member or wedge assembly 14 shown in FIGS. 8 and 9 is slidably receivable within the passageway 27 of the abrasive sleeve member 24 and within the tubular honing assembly 12 including within the passageway 21 of the retainer member 20, within the passageway 51 of the tubular cage portion 50, and within the passageway 16 extending through the drive member 13. The expander member 14 includes an externally threaded portion 57 on one end thereof for attaching to means (not shown) on the honing machine for moving the expander member 14 axially relative to the abrasive sleeve member 24. The expander member 14 further includes a hexagonal head portion 58 at its opposite end. The hexagonal head portion 58 is used to tighten the threaded end 57 to a honing machine at a torque greater than what the expander member 14 will experience during honing operations. In this way, the expander member 14 is prevented from becoming disconnected from the honing machine during operation.

The expander member 14 also includes an axially conically tapered outer surface portion 60 extending from the hexagonal head end portion 58 thereof to an intermediate location therealong as best shown in FIG. 8, and a substantially cylindrical outer surface portion 62 extending partially therealong from its threaded end portion 57. The cylindrical surface portion 62 has a cross-sectional diameter less than the minimum cross-sectional diameter of the conically tapered expander surface portion 60, and less than the smallest cross-sectional diameter of the aligned passageways 21, 51 and 16 extending through the assembled tubular honing member 12 and the passageway 27 extending through the abrasive sleeve member 24. Therefore, when the expander member 14 is axially inserted into the tubular honing member 12 and the abrasive sleeve member 24, the cylindrical surface portion 62 of the member 14 will pass through the respective passageways of the members 20, 24, 18 and 13 without obstruction.

The conically tapered outer surface portion 60 of the expander member 14 is also tapered at the same taper rate as the taper associated with the inner surface 26 of the abrasive sleeve member 24. This means that when the abrasive sleeve member 24 is properly oriented within the cage member 18, and the expander member 14 is slidably positioned through the honing assembly 12 and within the passageways 21, 27, 51 and 16 as shown in FIG. 1, the conically tapered outer surface portion 60 of the expander member 14 is brought into surface-to-surface contact with the inner surface 26 of the abrasive sleeve member 24. It is this surface-to-surface mating of the surfaces 26 and 60 that enables the abrasive sleeve member 24 to be expanded and contracted uniformly over its entire length as the expander member 14 is axially moved therethrough. This means that the full length of the sleeve member 24 including the raised honing surfaces 36 expands and contracts uniformly. The uniform expansion of the abrasive sleeve member 24 allows the honing pressure to remain substantially constant along the length of the abrasive honing surfaces 36 which, in turn, produces more uniform and more accurately honed work surfaces.

As previously discussed and as more clearly shown in FIG. 10, the fingers 44 of the cage member 18 are circumferentially arranged to form pairs of opposing fingers 44, the opposing fingers 44 of one such pair being of equal width to each other and being wider than the other pairs of fingers 44. For reasons explained hereinafter, it is necessary, when slidably positioning the abrasive sleeve member 24 into the cage member 18, to position one of the pair of wider fingers 44 in the expansion channel 29'. In this regard, it is important to note that during expansion of the abrasive sleeve member 24, the position of the drive channel 29'' is altered less than the other channels 29. It can therefore be appreciated that, except for the expansion channel 29', the remaining channels 29 each require sufficient space between their respective sidewalls 32 and the opposing finger side edges 49 located therebetween to prevent each sidewall 32 from contacting the adjacent finger edge 49 when the sleeve member 24 undergoes maximum expansion. In this way, the fingers 44 are prevented from interfering with the expansion of the sleeve member 24 and, at the same time, are protected from incurring transverse pressure from the sleeve member 24 which could cause the fingers 44 to warp, fracture or otherwise become fatigued and experience a material failure during a honing operation.

Positioning one of the pair of wider fingers 44 in the expansion channel 29' presents no risk of damage to that particular finger 44, nor does it present any problem with respect to sleeve expansion, because the sidewalls 32 of the expansion channel 29' will be forced away from each other and away from the opposing finger side edge surfaces 49 upon expansion of the sleeve member 24. Positioning the remaining wider finger 44 in the drive channel 29'' likewise presents no possibility of damage to that finger 44, nor does it pose any interference problems with respect to sleeve expansion, because the position of the drive channel 29'' undergoes little or no alteration during sleeve expansion. However, postioning the wider fingers 44 in any of the other channels 29 impinges on the space necessary to prevent the sidewalls 32 of those channels 29 from contacting the respective opposing side edge surfaces 49 of the wider fingers 44. This means that uniform expansion of the sleeve member along its full length may be hindered or otherwise impeded depending upon the amount of sleeve expansion required for a particular honing operation. For this reason, it is important that the wider fingers 44 always be aligned with the channels 29' and 29'' when the sleeve member 24 is positioned within the cage member 18.

Because the abrasive sleeve member 24 is free floating within the tubular honing assembly 12, the only way that rotational force is conveyed from the tubular honing assembly 12 to the sleeve member 24 is via the force applied by any of the finger side edge surfaces 49 against any of the opposing channel sidewalls 32. For the reasons discussed above, only the wider fingers 44 positioned in the expansion channel 29' and the drive channel 29'' respectively can contact the adjacent sleeve sidewalls 32 without incurring damage during expansion of the sleeve member 24 and without impairing the maximum range of expansion of the member 24. In this regard, upon expansion of the abrasive sleeve 24, the finger 44 positioned in the expansion channel 29' will no longer be in contact with the sidewalls 32 of the expansion channel 29' and, therefore, such finger can transmit no rotational force from the cage member 18 to the sleeve member 24. Therefore, only the finger 44 positioned in the drive channel 29'' transmits the rotational force from the cage member 18 to the abrasive sleeve 24. It is also advantageous to provide such rotational force from the cage 18 to the sleeve 24 with a minimal amount of slippage therebetween. Such slippage is inversely proportional to the width of the finger 44 positioned within the drive channel 29''. As a result, it is also important to position one of the wider fingers 44 within the drive channel 29''. Since the finger 44 positioned within the drive channel 29'' will be subjected to more stress during a honing operation as compared to the other fingers 44, a wider finger 44 in the drive channel 29'' will also increase its strength and durability in this capacity.

It should be noted that the sole function of the narrower fingers 44 is to stabalize the sleeve member 24 during operation. It should also be noted that the reasons for making the finger 44 positioned in the expansion channel 29' the same width as the opposing finger 44 which imparts rotational force between the cage member 18 and the sleeve member 24 are two-fold, namely, (1) it is easier and more economical to manufacture the cage member 18 if opposing fingers 44 are of the same width, and (2) an additional finger 44 of width suitable for imparting rotational force is thereby provided should the opposing finger 44 positioned within the drive channel 29" be damaged or otherwise exhibit wear and tear during use. This means that if the wider finger 44 positioned in the drive channel 29" becomes defective for any reason, the sleeve member 24 may be removed from the cage 18 and re-oriented therein such that the opposed wider finger 44 previously located within the expansion channel 29' now lies within the drive channel 29". This not only extends the useful life of the cage member 18, but it is also cost effective.

The drive member 13 is affixed to the honing machine by means that, ideally, create a frictional force sufficiently greater than any torque the tubular honing member 12 will encounter during a honing operation. During a typical honing operation, the expander member 14 rarely experiences a torque load. Should, however, the torque experienced during a particular honing operation overcome the frictional force retaining the tubular honing member 12 to the honing machine, the frictional force between the outer tapered surface portion 60 of the expander member 14 and the inner surface 26 of the abrasive sleeve member 24 is sufficient to overcome any such torque and, thereby, impart the necessary rotational force to the sleeve member 24 and the tubular honing assembly 12. It should be noted that this is the only scenario where the expander member 14 encounters any torque. Even in this remote situation, the present abrasive sleeve member 24 expands and contracts uniformly along its entire length.

The tubular portion 50 of the cage member 18 also includes a pair of opposing apertures 64 which extends through the respective sidewall portions of such member so as to provide means for an elongated member (not shown) to be inserted therethrough to function as a lever or wrench to enable the cage member 18 to be tightened to or loosened from the drive member 13. The ease with which the cage member 18 can be quickly removed from, or attached to, the drive member 13 enables an operator to easily exchange one cage member 18 for a different sized cage member, or to replace a damaged cage member, without having to perform the time consuming task of detaching and reattaching the drive member 13 to and from the honing machine. Likewise, the ease with which the pilot member 20 can be removed from the cage member 18 permits an operator to quickly replace the abrasive sleeve member 24 without having to detach the cage member 18 or the drive member 13. The time saving advantages provided by the modular design of the present tubular honing assembly 12 can therefore be quickly appreciated.

Also, importantly, the modular construction of the present mandrel 10 allows a plurality of different abrasive sleeve members having raised honing surfaces 36 located at different radial heights or at different honing diameters can be interchangeably utilized with the same cage member 18 to expand the normal range of honing diameters which can be honed with the present tool 10. It is also anticipated that a plurality of different expander members as well as a plurality of different pilot members could likewise be interchangeably used with the various modular components of the present tool 10 to further increase the range of honing diameters achievable with such tool 10. In this regard, any plurality of different sleeve members 24, different cage members 18 different expander members 14 and different pilot members 20 can be sized, shaped and dimensioned so as to be interchangeably engageable with each other as well as with the same drive member 13. In fact, one sleeve member 24 could be used to achieve a certain range of honing diameters and other sleeve members could be used thereafter to build upon and achieve additional ranges of even greater honing diameters. It is also recognized and anticipated that other constructional modifications to the abrasive sleeve member 24 as well as to the cage member 18 and pilot member 20 can likewise accomplish this end. This capability greatly increases the usefulness and versatility of the present honing tool 10.

Although some of the benefits and advantages of the modular capability of the present mandrel 10 as explained above may be sacrificed, it is also recognized and anticipated that the modular members 13, 18 and 20 can be integrally formed in various combinations with each other without departing from the spirit and scope of the present invention. For example, the tubular honing assembly 12 could be fabricated into a one piece, a two piece or a three piece construction. In this regard, the drive member 13 and the cage member 18 could be integrally formed into a single member; the cage member 18 and the pilot member 20 could likewise be integrally formed, with some modifications, into a single member; or all three members 13, 18 and 20 could be fabricated as a single member adaptable to cooperatively receive the abrasive sleeve member 24. Other variations and combinations of the various components of the present mandrel are likewise anticipated.

Thus, there has been shown and described a novel honing tool construction, which construction fulfills all of the objects and advantages sought therefor. Many changes, modifications, variations and other uses and applications of the present device will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A honing mandrel adjustable during a honing operation comprising an elongated tubular member having means at one end portion thereof for attaching to a honing machine, a plurality of circumferentially spaced longitudinally extending slots in said elongated tubular member, a tubular honing member having inner and outer surfaces, said inner surface being conically tapered over the length thereof, said outer surface including a plurality of radially outwardly extending honing portions circumferentially spaced to correspond to the spacing of the longitudinal slots in said elongated tubular member, each of said radially outwardly extending honing portions having an abrasive surface formed thereon, means through one side of said tubular honing member to permit expansion and contraction of the diameter of said member substantially uniformly along the length thereof during a honing operation, and an elongated expander member positioned extending through said elongated tubular member, said expander member having an outer surface conically tapered over at least a portion of the length thereof, the outer surface of said expander member being tapered at the same taper rate as the conical taper of the inner surface of said tubular honing member, the tapered portion of said expander member being slidably engageable in surface-to-surface contact with the tapered inner surface of said honing member, and means at one end portion of said expander member for attaching said expander member to means for producing longitudinal movement of said expander member relative to said elongated tubular member.

2. The honing mandrel defined in claim 1 wherein said means through one side of said elongated tubular member is a slot that extends the full length thereof.

3. The honing mandrel defined in claim 1 wherein said means at one end portion of said elongated tubular member for attaching to a honing machine includes a drive member, said drive member being cooperatively engageable with said elongated tubular member.

4. The honing mandrel defined in claim 1 including means for holding the tubular honing member in operative engagement with the elongated tubular member during a honing operation.

5. A honing mandrel adjustable during a honing operation and rotatable about an axis of rotation comprising an elongated tubular assembly having an inner surface, an outer surface, a plurality of circumferentially spaced longitudinal apertures extending over a portion thereof, and means adjacent one end of said tubular assembly for attaching said assembly for rotation to a honing machine, a substantially tubular sleeve member positionable within said tubular assembly, said sleeve member having an inner surface conically tapered over substantially the length thereof and having an outer surface including a plurality of radially outwardly extending honing projections circumferentially spaced so as to correspond to the spacing of the longitudinal apertures in said tubular assembly, each of said radially extending honing projections having a work engaging abrasive surface formed along at least a portion thereof and each being receivable within a respective longitudinal aperture in said tubular assembly, said work engaging abrasive surfaces all lying on a substantially cylindrical envelope, means through one side of said sleeve member extending the full length thereof to permit radial expansion and contraction of said sleeve member substantially uniformly along the length thereof during a honing operation, and an elongated expander member positioned extending through said tubular assembly and having an outer surface conically tapered over at least a portion thereof, the inner tapered surface of said sleeve member being in surface-to-surface contact with the conically tapered outer portion of said expander member when said expander member is positioned extending through said tubular assembly, said expander member including means at one end portion thereof for attaching to means on a honing machine to produce relative longitudinal movement between said tubular assembly and said expander member during rotation thereof to change the diameter of the outer surface of said sleeve member during a honing operation.

6. A honing mandrel defined in claim 5 wherein said means through one side of said sleeve member includes a slot extending the length thereof.

7. The honing mandrel defined in claim 5 wherein said tubular assembly includes a drive member, a cage member, and a retainer member, each of said members having a passageway extending therethrough and each including means for permitting said members to be fastened together in longitudinal alignment with each other such that the respective passageways extending through said members lie in registration with each other when said members are fastened together.

8. The honing mandrel defined in claim 7 wherein said plurality of circumferentially spaced longitudinally extending aperatures are positioned and located on said cage member.

9. The honing mandrel defined in claim 8 wherein said retainer member holds said sleeve member is operative engagement within said cage member during a honing operation.

10. A honing mandrel adjustable during a honing operation comprising an elongated tubular member having means adjacent one end portion thereof for mounting to a honing machine, said elongated tubular member having a plurality of circumferentially spaced longitudinally extending fingers associated with its opposite end portion, said plurality of longitudinal fingers defining a plurality of longitudinally extending slots located respectively circumferentially therebetween, a tubular honing member slidably positionable between said plurality of circumferentially spaced longitudinal fingers, said tubular honing member having inner and outer surfaces, said inner surface being conically tapered over the length thereof, said outer surface including a plurality of circumferentially spaced outwardly extending abrasive honing surfaces, each of said abrasive honing surfaces being positioned and located so as to be receivable within a corresponding longitudinal slot in said elongated tubular member, an elongated opening through said tubular honing member extending the full length thereof to permit expansion and contraction of the diameter of said member during a honing operation, and an elongated expander member positionable extending through said tubular honing member and through said elongated tubular member, said expander member having an outer surface conically tapered over at least a portion of the length thereof, the outer surface of said expander member being tapered at the same taper rate as the conical taper of the inner surface of said honing member such that the tapered portion of said expander member is slidably engageable in surface-to-surface contact with the tapered inner surface of said honing member, means for holding said honing member in operative engagement with said elongated tubular member, and means attached to one end portion of said expander member to permit longitudinal movement of said expander member relative to said honing member.

11. The honing mandrel defined in claim 10 wherein said tubular honing member includes a plurality of circumferentially spaced channels, each of said channels being positioned and located between a respective pair of adjacent abrasive honing surfaces and each being dimensioned so as to slidably receive a corresponding longitudinal finger associated with said elongated tubular member.

12. The honing mandrel defined in claim 11 wherein each of said channels is longitudinally tapered over substantially the length thereof at the same taper rate as the conical taper associated with the inner surface of said honing member.

13. The honing mandrel defined in claim 12 wherein each of said plurality of fingers includes an inner surface portion, each of said inner finger surface portions being tapered at the same taper rate as the longitudinal taper of said channels.

14. The honing mandrel defined in claim 10 wherein each of said plurality of fingers includes a plurality of spaced orifices.

15. The honing mandrel defined in claim 10 wherein said plurality of fingers are arranged in opposed pairs, each pair of opposed fingers being identical in width.

16. The honing mandrel defined in claim 15 wherein one of said pairs of opposed fingers has a width greater than the other of said pairs of opposed fingers.

17. A honing mandrel adjustable during a honing operation and rotatable about an axis of rotation comprising an elongated tubular member having means adjacent one end portion thereof for mounting to a honing machine for rotation therewith and including a plurality of circumferentially spaced longitudinally extending fingers associated with its opposite end portion, said plurality of longitudinal fingers defining a tubular space therebetween, a substantially tubular sleeve member slidably positionable within the tubular space defined by said plurality of fingers, said tubular sleeve member having inner and outer surfaces, said inner surface being conically tapered over the length thereof, said outer surface including a plurality of circumferentially spaced longitudinally extending channels and a plurality of circumferentially spaced radially outwardly extending honing portions, each of said honing portions having an abrasive surface formed thereon, each of said circumferentially spaced longitudinal channels being positioned and located so as to receive a corresponding longitudinal finger when said sleeve member is slidably positioned within the tubular space defined by said plurality of fingers, means through said tubular sleeve member extending the full length thereof to permit expansion and contraction thereof during a honing operation, and an elongated expander member positioned extending through said sleeve member, said expander member having an outer surface conically tapered over at least a portion of the length thereof, the outer surface of said expander member being tapered at the same taper rate as the conical taper of the inner surface of said sleeve member and being in surface-to-surface contact with the tapered inner surface of said sleeve member when positioned extending therethrough, and means at one end portion of said expander member for attaching to means to produce longitudinal movement of said expander member relative to said sleeve member during rotation thereof to change the diameter of said sleeve member during a honing operation.

18. The honing mandrel defined in claim 17 wherein said means through one side of said sleeve member extending the full length thereof includes a slot.

19. The honing mandrel defined in claim 17 wherein the inner surface of each of said plurality of fingers is conically tapered at the same taper rate as the conical taper of the inner surface of said tubular sleeve member.

20. The honing mandrel defined in claim 19 wherein each of said plurality of channels is longitudinally tapered over substantially the length thereof at the same taper rate as the conical taper of the inner surface of said plurality of fingers.

21. The honing mandrel defined in claim 17 wherein each of said plurality of fingers includes a plurality of spaced orifices.

22. The honing mandrel defined in claim 17 wherein said expander member includes means adjacent its opposite end portion for receiving a tool for securely affixing the expander member to said means producing longitudinal movement of said expander member relative to said sleeve member.

* * * * *